US005491917A

United States Patent [19]

Dilhan et al.

[11] Patent Number: 5,491,917

[45] Date of Patent: Feb. 20, 1996

[54] WEAPONS SYSTEM HAVING A SHOCK ABSORBER

[75] Inventors: Denis Dilhan, Auterive; Jean Baricos, Ramonville St. Agne, both of France

[73] Assignee: Etienne Lacroix Tous Artifices S.A., Muret, France

[21] Appl. No.: 244,267

[22] PCT Filed: Nov. 20, 1992

[86] PCT No.: PCT/FR92/01079

§ 371 Date: May 20, 1994

§ 102(e) Date: May 20, 1994

[87] PCT Pub. No.: WO93/10418

PCT Pub. Date: May 27, 1993

[30] Foreign Application Priority Data

Nov. 20, 1991 [FR] France ..... 91 14347

[51] Int. Cl.[6] ..... F41A 1/10

[52] U.S. Cl. ..... 42/106; 89/1.701; 89/44.02; 89/177

[58] Field of Search ..... 89/1.701, 1.702, 89/1.703, 44.02, 198, 177, 42.01, 44.01; 42/1.06

[56] References Cited

U.S. PATENT DOCUMENTS

| | | | |
|---|---|---|---|
| 954,799 | 4/1910 | Hammond | 89/177 |
| 2,520,971 | 9/1950 | Simpson | 89/177 |
| 3,417,660 | 12/1968 | Harbrecht | 89/198 |
| 4,672,881 | 7/1986 | Betts et al. | 89/1.816 |

FOREIGN PATENT DOCUMENTS

| | | | |
|---|---|---|---|
| 429320 | 5/1991 | European Pat. Off. . | |
| 2658597 | 8/1991 | France . | |
| 1228535 | 11/1966 | Germany | 89/1.701 |
| 8904451 | 5/1989 | WIPO | 89/1.703 |

OTHER PUBLICATIONS

Intl. Search Report PCT/FR92/01079.

*Primary Examiner*—Stephen M. Johnson
*Attorney, Agent, or Firm*—Pollock, Vande Sande & Priddy

[57] ABSTRACT

Weapons system comprising a fixed reference, a launcher tube slidingly mounted in relation to the fixed reference and a damper inserted between the fixed reference and the launcher tube. The weapon further comprises a lock serving as a stop for the damper in the launching position, so as to avoid displacement of the damper in the initial launching phase, and a sensor which reacts to projectile launching, capable of releasing the lock so as to rearwardly eject the unit formed by the damper and the launcher tube.

12 Claims, 3 Drawing Sheets

WEAPONS SYSTEM HAVING A SHOCK ABSORBER

FIELD OF THE INVENTION

The present invention relates to the field of weapons systems fitted with shock absorbers.

A particular application of the present invention lies in weapons systems fired from the shoulder, and particularly but not exclusively an antitank weapons system. Other applications include the field of artillery and weapons for light infantry.

BACKGROUND OF THE INVENTION

Various weapons systems have already been proposed of the type comprising a fixed reference, a launch tube slidably mounted relative to the fixed reference, and a shock absorber interposed between the launch tube and the fixed reference.

Such systems are described, for example, in FR-A-2 625 800, FR-A-2 644 571, and in applicant's French Patent Applications Nos. FR 89 14210, FR 89 1420 FR 90 10684 and FR 91 01621.

For a shoulder-fired weapon, the fixed reference may be in the form of a shoulder piece, a butt, or a pistol grip. In other cases the fixed reference may be in the form of a gun mount.

As shown in FIG. 1, the shock absorbers described in the above-mentioned documents serve essentially to transform an input force Fe of short duration and great intensity as applied to the launch tube while ejecting a projectile into a longer duration and smaller intensity output force Fs as applied to the fixed reference, and as shown in FIG. 2.

For a shoulder weapon, the shock absorber is preferably designed to transform the input force Fe into an output force Fs of amplitude no greater than 12,000N and of duration shorter than 0.2 seconds.

The weapons systems described in the above-mentioned documents have a major advantage. In general, they do indeed enable the peak of the input force Fe to be clipped, thereby avoiding injuring the user.

However, those known weapons systems do not always give satisfaction. Experience has shown that, for projectiles of great mass and/or high ejection velocity, the energy transmitted to the fixed reference is large even if it is spread out over time, and it therefore succeeds in pushing over the firer when firing from the shoulder after some critical length of time Tc.

SUMMARY OF THE INVENTION

An object of the present invention is to eliminate the above-mentioned drawback of the prior art.

According to the present invention, this object is achieved by a weapons system of known type comprising a fixed reference, a launch tube slidably mounted relative to the fixed reference, and a shock absorber interposed between the fixed reference and the launch tube, the system being characterized by the fact that it further comprises a latch serving as an abutment for the shock absorber in the launch position, to prevent the shock absorber from moving during an initial stage of launch, and sensor means responsive to launch of the projectile and suitable for releasing the latch so that it then allows the assembly constituted by the shock absorber and the launch tube to be ejected rearwardly.

BRIEF DESCRIPTION OF THE DRAWINGS

Other characteristics, objects, and advantages of the present invention, and in particular the description of various embodiments of the sensing means, are contained in the following detailed description, made with reference to the accompanying drawings and given by way of example.

DETAILED DESCRIPTION

Figure 3:
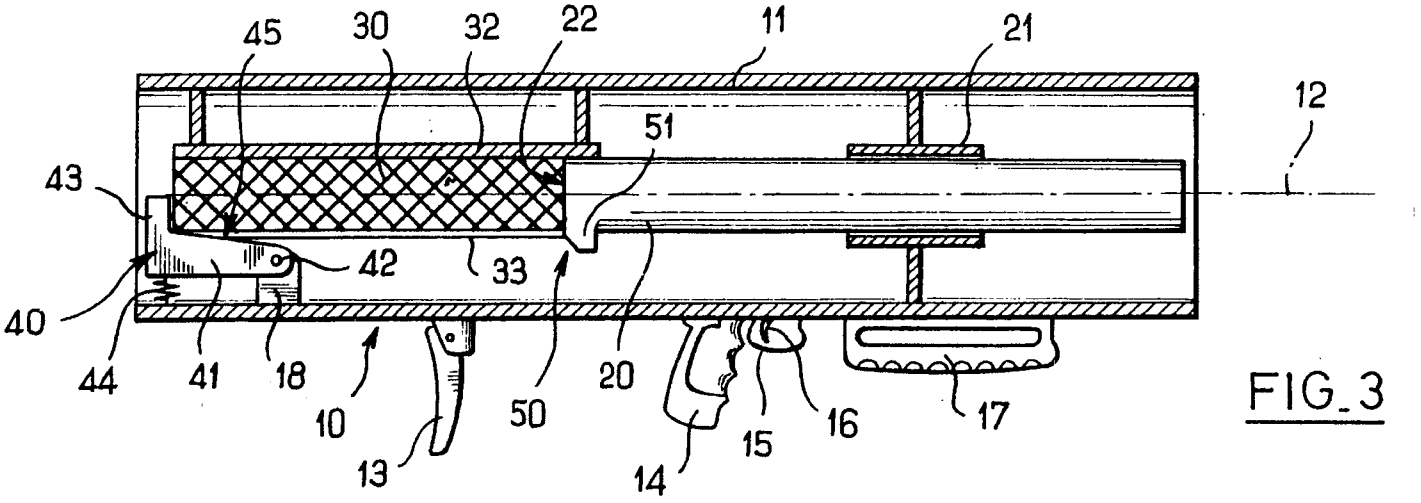
FIG. 3 is a schematic longitudinal section through a weapons system in accordance with the present invention.

More precisely, accompanying FIG. 3 shows a weapons system designed for firing from the shoulder.

This weapons system comprises:

a fixed reference 10;

a launch tube 20;

a shock absorber 30;

a latch 40; and sensing means 50 responsive to the launching of a projectile to release the latch 40.

In the example shown in FIG. 3, the fixed reference 10 is constituted by a gunstock 11 centered on an axis 12. The gunstock 11 includes a butt 13, a pistol grip 14, a trigger guard 15 surrounding firing control means constituted, for example, by a trigger 16, and a longitudinal fore-end grip 17. The gunstock 11 is open at the front to allow a projectile 60 to depart. It is also open at the back to allow the shock absorber 30 and the tube 20 to be ejected after the latch 40 has been released.

The particular fixed reference 10 shown in FIG. 3 is not limiting in any way. It may be varied in numerous ways for weapons fired from the shoulder. It may also be constituted by a gun mount for an artillery weapon.

The launch tube 20 is slidably guided along the axis 12 relative to the fixed reference 10, and more precisely inside the gunstock 11. In the embodiment of FIG. 3, the tube 20 is guided by a guide bearing 21 secured to the fixed reference 10.

The shock absorber 30 may be formed by any structure known per se, and particularly, but not exclusively, by structures as described in the above-specified documents. In the embodiments that are presently considered as being preferred, the shock absorber 30 is built on the basis of pre-buckled honeycomb structures or on the basis of hollow metal beads.

In the example shown in FIG. 3, the shock absorber 30 is placed behind the tube 20 relative to the launch direction, and it is centered on the axis 12. In a variant, the shock absorber 30 could be placed around the tube 20, with means being provided to connect the tube 20 to the front face of the shock absorber 30.

The shock absorber 30 is thus interposed between the rear face 22 of the tube 20 and the latch 40 which is itself connected to the fixed reference 10.

The latch 40 may be embodied in numerous different ways. In FIG. 3, the latch 40 comprises a moving plate 41 extending substantially parallel to the axis 12. The plate 41 is hinged at its front end about a horizontal axis 42 to a support 18 which is connected to the inside surface of the gunstock 11. At its rear end, the plate 41 carries a catch 43. The plate 41 is urged towards the axis 12 by a spring 44. The spring 44 is interposed between the plate 41 and the inside surface of the gunstock 11. Thus, in the launch position, the catch 43 engages the shock absorber 30 and serves as a rear abutment for the shock absorber 30.

The longitudinal face 45 of the plate 41 facing the shock absorber 30, i.e., the axis 12, is oblique relative to said axis, sloping towards it in a rearward direction.

The sensor means 50 responsive to a projectile being launched and adapted to release the latch 40 may be embodied in numerous different ways. They are preferably designed to release the latch 40 after the projectile 60 has escaped from the launch tube 20, as shown schematically on the right in FIG. 4.

More precisely, in the embodiment shown in FIG. 3, the sensor means 50 are mechanical and are constituted by a nose 51 connected to the rear end of the launch tube 20.

The device shown in FIG. 3 operates essentially as follows.

Figure 1:
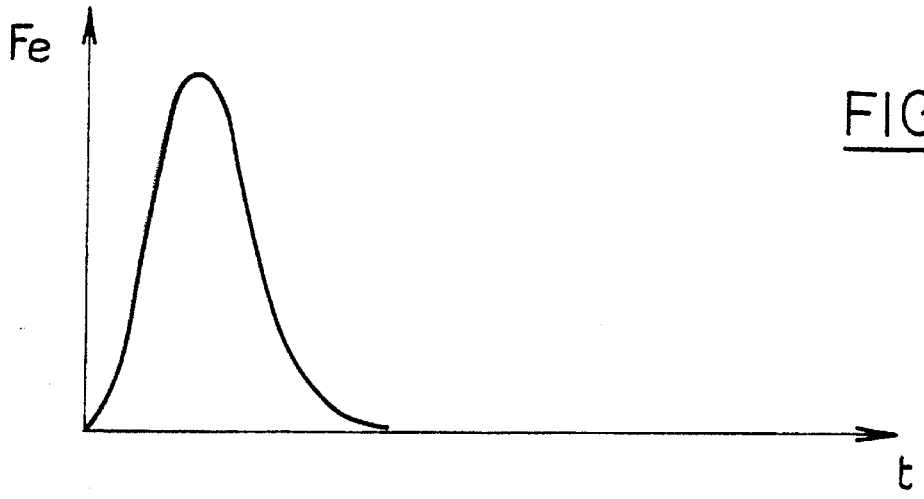
FIG. 1 is a diagram showing the amplitude of the input force Fe as a function of time as applied to a launch tube while a projectile is being ejected.
Figure 2:
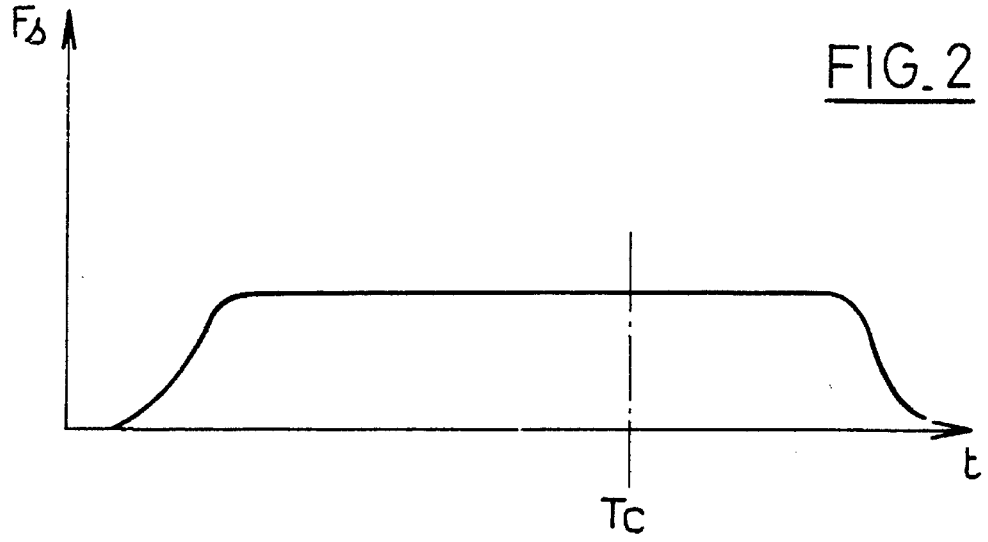
FIG. 2 is a diagram showing the amplitude of the output force Fs as a function of time as applied to the fixed reference in a known weapon fitted with a shock absorber and as mentioned above.
Figure 6:
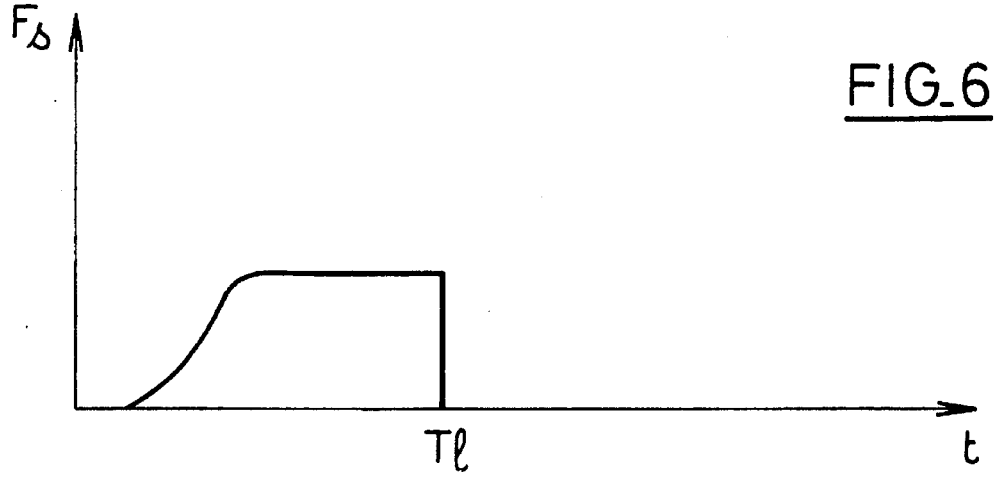
FIG. 6 is a diagram showing the amplitude of the output force Fs as a function of time as applied to the fixed reference by a weapon in accordance with the present invention.

Actuation of the firing means 16 initiates ejection of the projectile 60 from the tube in conventional manner and using means not shown in the figures. The departure of the projectile 60 generates an input force Fe as shown in FIG. 1 on the launch tube 20. The launch tube 20 bears against the shock absorber 30. Rearward movement of the shock absorber is prevented by the latch 40. Consequently, the shock absorber deforms progressively as represented at 31 in FIG. 4. This deformation 31 serves to clip the peak of the input force Fe. The output force Fs as transmitted to the latch 40 and to the fixed reference 10 is thus of smaller amplitude, as shown in FIG. 6. The amplitude of the output force Fs transmitted to the fixed reference 10 and thus to the user is equal to that shown in FIG. 2.

Figure 5:
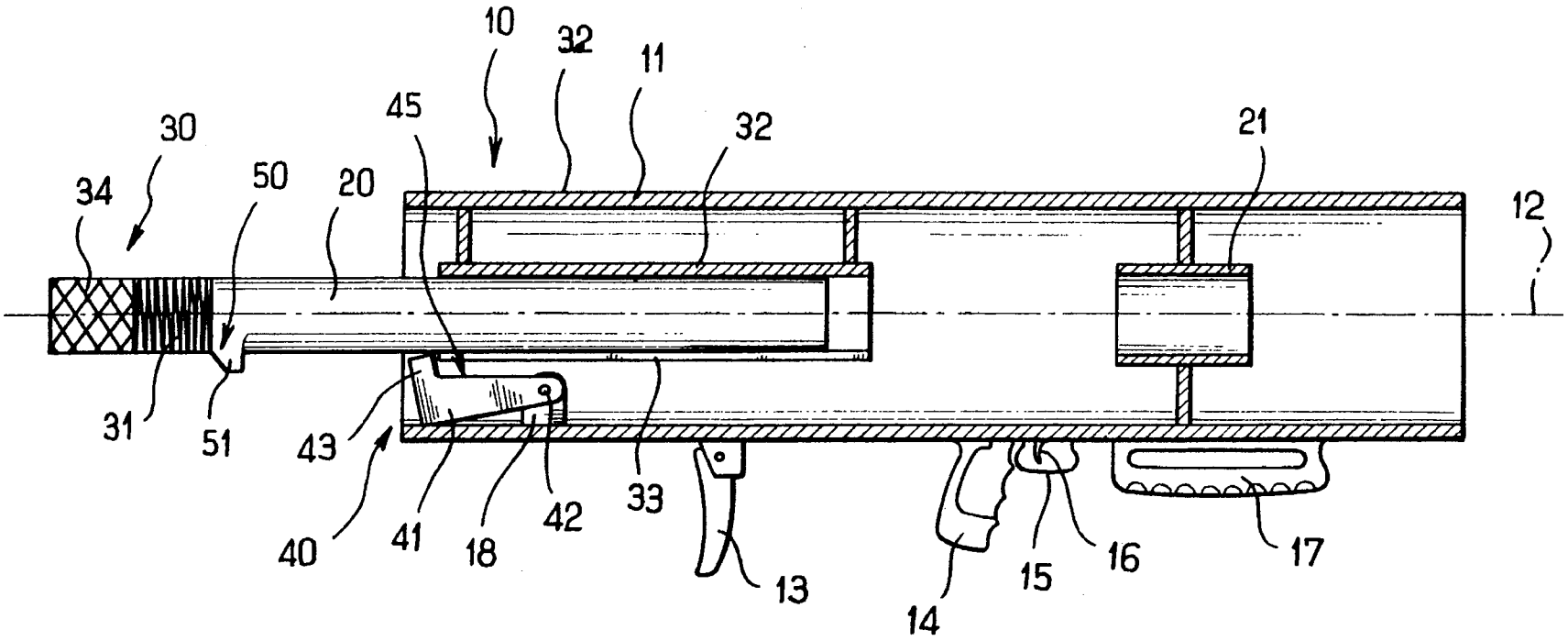
FIG. 5 shows the same weapons system after the latch has released.

When the nose 51 engages the ramp 45 formed on the latch 40, the latch is moved away from the axis 12 and releases the shock absorber 30. The assembly constituted by the shock absorber 30 and the launch tube 20 is consequently ejected rearward after the latch 40 has been released, as shown in FIG. 5. The force Fs applied to the fixed reference 10 becomes zero at the instant T1 that the latch 40 is released, as shown in FIG. 6.

Preferably, the shock absorber 30 is itself slidably guided along the axis 12 in a guide sleeve 32 connected to the fixed reference 10. The sleeve 32 includes a longitudinal slot 33 through which the unlatching nose 51 passes.

In the above-described embodiment, the latch 40 is released by mechanical means after the tube 20 has moved through a predetermined distance, and more particularly when the nose 51 reaches the ramp 45.

In general, whatever the embodiment, the unlatching instant T1 must occur before the critical instant Tc is reached. In addition, it is preferable for the unlatching instant T1 to occur after the projectile 60 has left the muzzle, even though in certain cases it is possible to allow the latch to be released immediately before it leaves the muzzle.

The distance before launch between the nose 51 and the latch ramp 45, i.e., the recoil stroke allowed for the tube 20 before releasing the latch 40, can easily be set to satisfy the conditions mentioned above. Since the output force Fs has an amplitude that is substantially constant, the recoil speed of the tube 20 is likewise substantially constant. Consequently, the time between the release instant T1 and the initiation of projectile launch, is practically proportional to the distance before launch between the nose 51 and the ramp 45 of the latch.

The sensor means 50 responsive to projectile launch and acting on the latch 40 may be implemented in numerous other ways.

Thus, it is possible to provide a pickup responsive to displacement of the tube 20 and acting on the latch 40 when the recoil stroke of the tube has reached a predetermined threshold.

It is also possible to provide unlatching means for releasing the latch 40 that comprise sensors responsive to the projectile 60 leaving the muzzle.

In yet another variant, the means 50 responsive to projectile launch and acting on the latch to release it are responsive to the force exerted by the tube. The means 50 thus release the latch once the force exerted by the tube 20 reaches a predetermined threshold. In practice, the unlatching means 50 may be constituted by a latch element 40 that is adapted to break when the predetermined force threshold is reached, e.g., the pin 42 or the latch 40 itself which is provided with a line of controlled weakness. Naturally, the latch is not limited to the shape shown in the accompanying figures.

Figure 4:
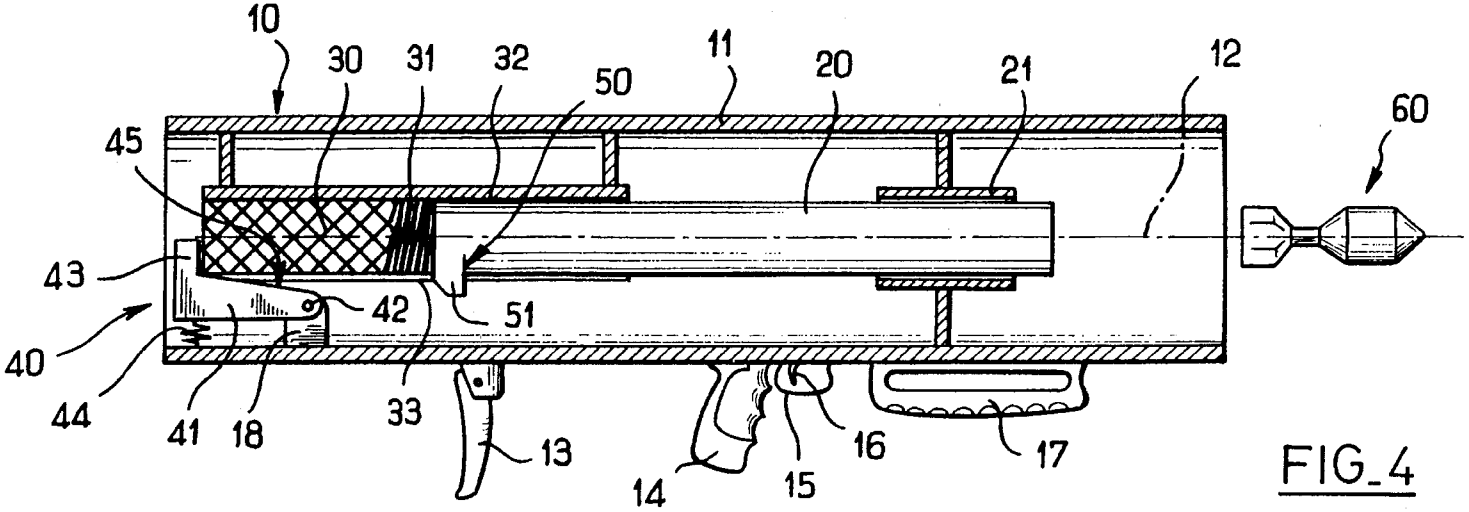
FIG. 4 shows the same weapons system in an initial stage of projectile ejection.

FIGS. 3 to 5 show a single-tube weapon. The invention also applies to multi-tube weapons. For these, provision may be made either for each tube to be ejected successively and individually by providing each of the tubes with its own latch and sensor means responsive to launch of the associated projectile, or else provision may be made for the various tubes to be ejected simultaneously on a single occasion after the x-th shot.

As shown schematically in the drawings the length of the shock absorber 30 is preferably greater than the length thereof as deformed by the tube 20 at the instant T1 the latch 40 is released.

In FIG. 5, reference 34 is given to the portion of the shock absorber 30 that has not been deformed at the instant the latch 40 is released. This non-deformed portion 34 may serve to absorb shock when the shock absorber and tube assembly 30-20 impacts against an obstacle situated behind the weapons system after the assembly has been ejected.

Where appropriate, in order to prevent a firer from being thrust forward by reaction when the output force Fs is suddenly taken off the fixed reference 10 at instant T1, it is possible to for the shock absorber to be released progressively rather than suddenly and completely, e.g., by means of a brake acting on the shock absorber 30.

What is claimed is:

1. A weapons system comprising a fixed reference, a launch tube slidably mounted relative to said fixed reference, a shock absorber (30) interposed between said fixed reference and said launch tube, a latch constituting an abutment for said shock absorber in a launch position to prevent movement of said shock absorber during an initial stage of launch, and sensor means responsive to launch of a projectile and suitable for releasing said latch so that said latch then allows an assembly constituted by said shock absorber and said launch tube to be ejected in a direction opposite said projectile.

2. The weapons system according to claim 1, wherein said sensor means are responsive to displacement of said launch tube.

3. The weapons system according to claim 1 or 2, wherein said sensor means are constituted by mechanical means.

4. The weapons system according to claim 1, wherein said sensor means comprise a nose associated with said launch tube and adapted to act on said latch.

5. The weapons system according to claim 1, wherein said sensor means comprise a sensor suitable for detecting displacement of said launch tube and for releasing said latch when said displacement of said launch tube reaches a predetermined threshold.

6. The weapons system according to claim 1, wherein said sensor means are responsive to emergence of said projectile from said launch tube.

7. The weapons system according to claim 1, wherein said sensor means are responsive to a force exerted by said launch tube so as to release said latch when said force reaches a predetermined force threshold.

8. The weapons system according to claim 7, comprising a latch element adapted to break when said predetermined force threshold is reached.

9. The weapons system according to claim 1, wherein said shock absorber comprises hollow metal beads.

10. The weapons system according to claim 1, wherein said shock absorber comprises a pre-buckled honeycomb.

11. The weapons system according to claim 1, wherein a length of said shock absorber is greater than a deformed length of said shock absorber on release of said latch.

12. The weapons system according to claim 1, wherein said fixed reference is adapted to be fired from a shoulder.

* * * * *